US005087299A

United States Patent [19]

Fukuchi et al.

[11] Patent Number: 5,087,299

[45] Date of Patent: Feb. 11, 1992

[54] VIBRATION-PROOF TUNGSTEN WIRE

[75] Inventors: Mikiharu Fukuchi; Yasuhiko Nakano, both of Yokohama; Keisuke Hayashi, Chigasaki; Isamu Koseki, Yokosuka; Masami Ito, Kamakura; Ryozo Akiyama, Yokosuka, all of Japan

[73] Assignees: Kabushiki Kaisha Toshiba, Kawasaki; Toshiba Material Engineering Corporation, Yokohama, both of Japan

[21] Appl. No.: 557,715

[22] Filed: Jul. 25, 1990

[30] Foreign Application Priority Data

Apr. 5, 1989 [JP] Japan ..... 1-84898

[51] Int. Cl.[5] ..... B22F 3/10; C22C 27/04

[52] U.S. Cl. ..... 148/11.5 P; 75/248; 75/952; 148/11.5 F; 148/423; 419/4; 420/430

[58] Field of Search ..... 75/248, 952; 148/423, 148/11.5 F, 11.5 P; 420/430; 419/3, 4

[56] References Cited

U.S. PATENT DOCUMENTS 3,853,492 12/1974 Millner et al. ..... 420/430

FOREIGN PATENT DOCUMENTS 53-44131 11/1978 Japan ..... 148/423

57-39152 3/1982 Japan ..... 148/423

59-114749 7/1984 Japan ..... 148/423

*Primary Examiner*—R. Dean

*Assistant Examiner*—Robert R. Koehler

*Attorney, Agent, or Firm*—Foley & Lardner

[57] ABSTRACT

A vibration-proof tungsten wire which forms, in cases where the diameter of the wire is D mm and when an electric current corresponding to 90% of the fusion current value is passed therethrough for 5 minutes, a wire having a crystal grain boundary at which bubbles of 0.3 μm or less in diameter are dispersed in bubble rows with lengths of $(0.39/D)^2 \times 3$ μm or more arrayed in the wire axis direction of said crystal grain boundary, and bubbles of 0.2 μm or less in diameter are randomly dispersed; and a crystal grain in which bubbles of 0.3 μm or less in diameter are dispersed in rows with lengths of $(0.39/D)^2 \times 30$ μm or more arrayed in the wire axis direction within said crystal grain, and bubbles of 0.2 μm or less are randomly dispersed;

a process for preparing the same; and a tungsten filament obtained from the above-defined wire. The doped tungsten wire of this invention possesses excellent vibration-proof property on lighting as well as high reliability.

11 Claims, No Drawings

VIBRATION-PROOF TUNGSTEN WIRE

BACKGROUND OF THE INVENTION

This invention relates to a tungsten (W) wire useful as the filament material for lamp, more particularly to a W wire which is useful as the wire when preparing a filament for, for example, a halogen lamp and which will not bring about any deformation or wire breaking of the filament not only during lighting at a high temperature above the filament temperature of incandescent lamp but also during use under severe vibration conditions.

A filament for lamp to be used under severe vibration conditions, for example, a filament for a halogen lamp is constituted typically of a doped W wire with high vibration-proof characteristic. Such a doped W wire is prepared as outlined below.

That is, first, $WO_3$ powder with a predetermined particle size distribution is formulated with dopants as represented by K, Si and Al. Then, the powder is subjected to reducing treatment in a hydrogen furnace to form W powder having the dopants carried thereon. Subsequently, the W powder is pressure molded into a green compact.

The green compact is pre-sintered at a temperature of, for example, about 1200 ° C., and current passage sintering is effected with the both ends thereof being used as terminals to form a sintered bar. The sintered bar is generally subjected to swaging, during which step the recrystallization heat treatment is applied thereto, followed further by drawing, to form a wire with a predetermined wire diameter.

In the series of processes, the dopant contained in the green compact behaves as described below.

First, in the sintering process, sintering which occurs between W powders proceeds, whereby crystal grains of W grow, and at the same time, the dopants are pyrolyzed with a part thereof being vaporized. In the sintered bar on completion of sintering, the dopants exist in a large number of small spherical dope pores or sintering pores.

Then, when sintered bar is swaged, the above-mentioned W crystal grains become a fibrous structure elongated in the wire axis direction, and at the same time the dope pore is deformed into a slender pore. When working is further progressed, the dope pore is gradually flattened in the wire axis direction.

Subsequently when the wire is subjected to secondary recrystallization treatment by heating at a high temperature (e.g. lamp flashing), the dopant is vaporized and, the fine bubbles arrayed with a certain length are formed in the wire axis direction.

Through the effect on a large number of these arrayed bubbles dispersed in the wire axis direction, growth of the recrystallized grains in the direction perpendicular to the wire axis direction is inhibited, and as a consequence, the growth of the recrystallized grains proceed selectively in the wire axis direction, whereby greatly lengthy recrystallized grains elongating in the wire axis direction is formed, and these are interlocked each other to improve deformation-proof property of the wire at a high temperature.

Shortly speaking, the dispersion mode of the arrayed bubbles affects grain growth during recrystallization of the wire, thereby affecting significantly the vibration-proof property, and the deformation-proof property at high temperatures.

Recently, halogen lamps have been used in various illumination fields, and the use environment is becoming more and more severe accompanied therewith. Under such circumstances, in the filament of the doped W wire commercially available so far, vibration-proof properties on high temperature lighting is insufficient, and the problems of deformation of the filament during lighting, further nonuniformity of luminous intensity distribution have been pointed out, and there is an increasing demand for development of a doped W wire with excellent vibration-proof property on lighting as well as with high reliability.

The present invention has been developed in order to respond to such demand, and its object is to provide a doped W wire excellent in vibration-proof property at high temperature.

SUMMARY OF THE INVENTION

The present inventors, in the process of making intensive studies in order to accomplish the above object, passed an electric current, through a conventional doped W wire with its wire diameter being made 0.39 mm, of the value corresponding to 90% of the fusion current value thereof for 5 minutes, and observed the recrystallized structure grown by heating by the resistance heat generation at that time. As a consequence, in the case of the commercially available doped W wire of the prior art, they have found the fact that arrayed bubbles exist in a plural number arrayed with lengths of approximately 2 μm under the state with fine bubbles of approximately 0.5 μm in diameter in the wire axis direction at the grain boundary of recrystallized grains. Also, other than these arrayed bubbles, existence of bubbles randomly dispersed was also confirmed. Further, when the same observation was conducted concerning within the individual crystal grains, a plurality of arrayed bubbles comprising bubbles of about 0.1 to 0.5 μm in diameter were found to exist, and also existence of bubbles randomly dispersed was confirmed.

The present inventors have made investigations about the dispersion of the arrayed bubbles existing at the crystal grain boundary and within the crystal grain, and also the relationships between the dispersion of the bubbles forming these arrayed bubbles and the vibration-proof property, and consequently found the fact that the vibration-proof property of the doped W wire is improved better than in the prior art when this dispersion is under the state as described below to develop the doped W wire of the present invention.

Further, it has been found that a doped W wire having a ratio of the length to the width (L/W) of the crystal grain in the secondary recrystallized structure which maintains a certain value or higher even when heated to a temperature of the secondary recrystallization temperature or higher at any temperature elevation rate is improved in its vibration-proof property.

More specifically, the vibration-proof W wire of the present invention, first, is characterized by the crystal grain boundary and the crystal grain shown below formed when the diameter is made 0.39 mm and a current of a value corresponding to 90 % of the fusion current value is passed for 5 minutes, namely: a crystal grain boundary at which bubbles of 0.3 μm or less in diameter are dispersed in bubble rows with lengths of 3 μm or longer arrayed in the wire axis direction of said crystal grain boundary, and bubbles of 0.2 μm or less in diameter randomly dispersed; and further a crystal grain in which bubbles of 0.3 μm or less in diameter are dispersed in rows with lengths of 30 μm or longer arrayed in the wire axis direction within said crystal grain, and bubbles of 0.2 μm or less in diameter randomly dispersed.

The W wire of the present invention has specific features in the arrayed bubbles and the randomly dispersed bubbles when heated at a predetermined temperature, and further in the dispersion and sizes of the bubbles constituting them.

In the present invention, these arrayed bubbles and randomly dispersed bubbles and their dispersion refer to the arrayed bubbles, randomly dispersed bubbles and their dispersion formed when the wire to be used is made to have a diameter of 0.39 mm, and the wire is heated at a temperature corresponding to the 90 % fusion current value for 5 minutes. The temperature at that time corresponds roughly to 3100° C.

First, in the W wire of the present invention, when heat treatment as mentioned above is applied, the arrayed bubbles dispersed in the wire axis direction of the recrystallized grain boundary have their length of 3 μm or more. If the length is less than 3 μm, perpendicular to the wire axis direction is not inhibited, whereby ultimately the deformation-proof at high temperatures, and the vibration-proof property of the wire are lowered. Preferably, it is 5 μm or more. Also, the bubble constituting the arrayed bubbles as mentioned above is made to have its diameter of 0.3 μm or less. If the diameter of the bubble becomes too large, the wire becomes the same state as when a so-called "void" is formed therein, whereby not only the deformation-proof at high temperatures but also the strength even at normal temperature will be lowered. Preferably, it is 0.2 μm or less.

Further, when bubbles are randomly dispersed in addition to the arrayed bubbles as described above at the crystal grain boundary, its diameter should be preferably 0.2 μm or less. This is because bubbles randomly dispersed with too large diameters will bring about lowering in strength of the wire. More preferably, it is 0.1 μm or less. Most preferably, they should be null.

Next, the arrayed bubbles dispersed in the wire axis direction within the crystal grain are made to have their array length of 30 μm or more. If the length is shorter than 30 μm, the deformation-proof at high temperatures, and vibration-proof property will be lowered. Preferably, it is 40 μm or more.

Also, the fine bubble constituting the arrayed bubbles is made to have its diameter of 0.3 μm or less, for the same reason as in the case of the fine bubble of the arrayed bubbles dispersed at the grain boundary. Preferably, it is 0.2 μm or less.

Further, when fine bubbles are randomly dispersed in addition to the arrayed bubbles as mentioned above within the crystal grain boundary, its diameter should be preferably 0.2 μm or less similarly as in the case of that at the crystal grain boundary More preferably, it is 0.1 μm or less. Most preferably, they should be null.

The dispersion of the arrayed bubbles and fine bubbles in the doped W wire of the present invention are specified as described above, and these are nothing but the specified numerical values corresponding to the case of the wire with its wire diameter of 0.39 mm If the wire material has a wire diameter of, for example, D mm instead of 0.39 mm, then dispersion of the arrayed bubbles, and the randomly dispersed bubbles in the wire are specified by the values multiplied by the ratio of the wire diameters of the both wires. That is, the length of the arrayed dope pores dispersed at the crystal grain boundary will be $(0.39/D)^2 \times 3$ μm or more, and the diameter of the bubble constituting it 0.3 μm or less. In the case of the arrayed dope pores dispersed within the crystal grain, their length will be $(0.39/D)^2 \times 30$ μm or more, and the diameter of the fine bubble constituting it 0.3 μm or less.

The average interval ratio $L_{cb}$ between the adjoining arrayed bubbles at the crystal grain boundary is in the range of 0.3 to 6, preferably 0.4 to 5, most preferably 0.5 to 3, and the average interval ratio $L_{cg}$ between the adjoining arrayed bubbles within the crystal grain is in the range of 0.2 to 5, preferably 0.3 to 3, most preferably 0.4 to 2, when the interval ratio L of two adjoining arrayed bubbles a and b is defined as follows:

$$L = \frac{l}{(d_a + d_b)/2}$$

wherein $d_a$ and $d_b$ are diameters of the bubbles a and b, respectively, and l is a space between the bubbles a and b.

The average density of the bubbles arrayed at a length of 3 μm or more at the crystal grain boundary is not less than 500 pieces/mm$^2$, preferably not less than 1000 pieces/mm$^2$ and most preferably 2000 pieces/mm$^2$. The average density of the bubbles arrayed at a length of 30 μm or more within the crystal grain is not less than 13 pieces/mm$^2$, preferably not less than 25 pieces/mm$^2$ and most preferably not less than 50 pieces/mm$^2$. Here, the average density of the bubbles is obtained by measuring the average number of bubbles in ten or more views using a microscope of 3000 or more magnifications and calculating the number of bubbles per one square millimeter (mm$^2$) therefrom.

Next, the vibration-proof, W wire of the present invention, secondarily,, is characterized by a ratio of length to width (L/W) of the crystal grain in the secondary recrystallized structure of 9 or more even when heated to a secondary recrystallization temperature or higher at any temperature elevation rate.

Here, the length of the crystal grain in the secondary recrystallized structure means the length in the wire axis direction of the wire, and the width of the crystal grain means the length in the direction perpendicular to the wire axis direction of the wire.

The numerical value of L/W of the secondary recrystallized structure is variable depending on the temperature elevation rate, and in the W wire of the present invention, it is required that the L/W of the secondary recrystallized structure should be constantly 9 or more, preferably 12 or more, even when it is elevated to the secondary recrystallization temperature or higher at any temperature elevation rate.

If L/W is lower than 9, growth of the crystal grain in the wire axis direction in the secondary recrystallized structure is not sufficient, whereby there is a fear that deformation may occur due to grain boundary slips.

In the present invention, "even when heated to a temperature of the secondary recrystallization temperature or higher at any temperature elevation rate" means heating to a temperature of the secondary recrystallization temperature or higher at any temperature elevation rate from slow current increasing at about 1 A/sec. to momentary current increasing heating at about 100 A/sec. during high temperature heating, such as lamp flashing.

The doped W wire of the present invention having the characteristics as described above can be prepared as described below.

First, tungsten ore is refined in conventional manner to obtain ammonium para-tungstate. Next, the ammonium paratungstate is reduced to obtain tungsten oxide, and by setting the reduction temperature in this step at a temperature higher by 50° to 150 ° C. than in conventional process, the impurities contained within tungsten oxide can be reduced. The reduction temperature of the ammonium para-tungstate is typically 300° to 600° C., preferably 400° to 500° C. Then, the tungsten oxide is mixed with a potassium (K) compound, and at least one of a silicon (Si) compound and an aluminium (Al) compound in the form of an aqueous solution thereof. The amount of the potassium compound is typically 0.3 to 0.7 wt %, preferably 0.4 to 0.5 wt % in terms of K; the amount of the silicon compound to be added is 0.2 to 0.6 wt %, preferably 0.3 to 0.5 wt % in terms of Si; and the aluminium compound to be added is 0.02 to 0.2 wt %, preferably 0.03 to 0.1 wt % in terms of Al, relative to the tungsten oxide. As the potassium compound, the silicon compound and the aluminium compound, there may be exemplified potassium chloride (KCl), potassium silicate ($K_2SiO_3$) and aluminium chloride ($AlCl_3$). The resulting mixture is then subjected to reduction under hydrogen atmosphere at a temperature of 600° to 900° C. to obtain metallic tungsten powder, followed by acid washing to remove superfluous dopants. The acid washing is usually carried out by mixing the metallic tungsten powder with a diluted hydrochloric acid; stirring the resulting mixture; and standing the mixture for sedimentation of the metal, followed by discharge of the supernatant liquid, this procedure being repeated until the solution or liquid becomes neutral.

The metallic tungsten powder obtained is molded and pressed in a metal mold, pre-sintered in a hydrogen furnace and then sintered by current passage to give a tungsten sintered bar. The pre-sintering may be carried out at a temperature of 1100° to 1300° C., preferably 1200° to 1300° C., for 3 to 4 hours. The current for sintering by current passage is typically 3700 to 4050 A, preferably 3800 to 3900 A. The current is passed usually for 15 to 20 minutes.

The sintered bar is subjected to swaging and drawing. In the course of these workings, for amelioration of workability, strain removal is performed by recrystallization heat treatment for plural times. By enhancing the wire diameter at which the final recrystallization heat treatment is applied in the recrystallization treatments to 30% to 50% in terms of sectional area ratio as compared with conventional process, the reduction of area of subsequent working is increased, resulting in progress of flattening of the dope pores, whereby the dope pores are elongated long in the axis direction of the wire to form a long arrayed dope pores.

According to the process as described above, it becomes possible to prepare the doped W wire of the present invention.

EXAMPLE 1

Tungsten ore was refined to obtain ammonium para-tungstate. Then, the ammonium para-tungstate was subjected to reduction at around 450° C. (elevated by 100° C. as compared with the prior art) to obtain tungsten oxide. Then, the tungsten oxide was admixed with a dopant of K, Si and Al in the form of an aqueous solution of compounds thereof in amount of 0.6 wt %, 0.4 wt % and 0.1 wt % in terms of K, Si and Al, respectively, relative to the amount of the tungsten oxide, and subjected to reduction at around 800° C. in a stream of hydrogen to obtain metallic tungsten powder, followed by acid washing to remove superfluous dopants.

The thus obtained tungsten powder was press-molded and heated at a temperature of 2600° to 3000° C. by passing therethrough an electric current to obtain a sintered tungsten bar.

The cross-section of the resulting sintered bar was of around 15 mm by around 15 mm. The sintered bar was subjected to swaging with heating at 1300° to 1500° C. and the final recrystallization was done with the bar of 8 mm (increased in sectional area ratio relative to that of the prior art by 44%), followed further by swaging with heating at 1200° to 1500° C. to obtain a wire of 3 mm in diameter which was then subjected to drawing to prepare a doped W wire with a wire diameter of 0.39 mm.

The doped W wire was heated by passing an electric current corresponding to 90% of the fusion current therethrough in a stream of hydrogen for 5 minutes.

For each doped W wire, its unit length (1 cm) was cut out and the bubbles dispersed in arrays at the grain boundary and within the grain of the recrystallized grain and the dispersion of fine bubbles constituting them were observed by a microscope, and the lengths of the bubbles arrayed and the diameters of the bubbles were measured to obtain the results shown as average values in Table 1.

Then, each doped W wire was further drawn to be made finer in diameter to 20 mg/200 mm (20 MG) and a filament of a halogen lamp (180 V, 250 W) was prepared.

The compulsory vibration test of the halogen lamp under lighted state was conducted, and the deformation state of the filament was observed. More specifically, a filament was formed by winding a wire of 20 MG in diameter on a mandrel of 0.5 mm in diameter. The filament length was 7 mm.

The test lamp was loaded with a load while adding vibration thereto while lightening at 180 V. The compulsory vibration test was carried out by applying continuously to the test for one hour an impact of 10 G while repeating the increase during 2.5 minutes and the decrease during 2.5 minutes between a vibration frequency of 20 to 60 Hz. After the vibration was applied, the deformation state of the filament was observed. Deformation of filament was defined by taking the deformation ratio in terms of the ratio of the deformation amount (x) of the filament center to the filament length (l) multiplied by 100, and one with a deformation ratio of 6 % or more is rated as deformed. One with a deformation ratio of 15 % or more as "great" and one with 6% to 15% as "medium".

The results are shown in Table 1.

COMPARATIVE EXAMPLES 1-3

For the W wires obtained according to the three kinds of methods namely the method in which the reducing temperature of tungsten oxide was made 450° C. (increased by 100° C. as compared with the prior art) but the final recrystallization heat treatment applied with the wire of 6 mm in diameter (the same as in the prior art) (Comparative example 1), the method in which the reducing temperature was made 350° C. (the same as in the prior art) and the final crystallization heat treatment with a diameter of 8 mm (increased in sectional area by about 44% as compared with the prior art) (Comparative example 3), and the method in which the reducing temperature and the final recrystallization heat treatment were the same as in the prior art (Comparative example 2), bubbles were observed by a microscope as in Example 1 to obtain the results as shown in Table 1.

Also, filaments were prepared in the same manner as in Example 1 except for using the doped W wires and compulsory vibration tests were conducted under the same conditions as in Example 1 to obtain the results which are also listed together in Table 1.

TABLE 1

| | Grain Boundary | | | Within grain | | | |
|---|---|---|---|---|---|---|---|
| | Arrayed Bubbles | | Bubbles randomly dispersed | Arrayed bubbles | | Bubbles randomly dispersed | Test result Presence of filament deformation |
| | Diameter (μm) | Length (μm) | Diameter (μm) | Diameter (μm) | Length (μm) | Diameter (μm) | |
| Example 1 | 0.2 | 6 | 0.1 | 0.2 | 50 | 0.1 | None |
| Comparative example 1 | 0.2 | 6 | 0.1 | 0.2 | 20 | 0.1 | Do (medium) |
| Comparative example 2 | 0.6 | 2 | 0.5 | 0.2 | 50 | 0.1 | Do (medium) |
| Comparative example 3 | 0.6 | 2 | 0.5 | 0.2 | 20 | 0.1 | Do (great) |

EXAMPLE 2

A doped tungsten wire was prepared in the same manner as in Example 1.

For the doped W wire obtained, the temperature was elevated up to 3140° C. by heating by current passage at temperature elevation rates of 1 A/sec and 100 A/sec. respectively. As the result, the L/W's of the secondary recrystallized structure of the wire obtained were found to be each 12.

Also, by use of the doped W wire, a filament was prepared in the same manner as in Example 1, and the compulsory vibration test conducted under the same conditions as in Example 1 to obtain the results shown in Table 2. Here, the deformation ratio of filament is represented in terms of the ratio of the deformation amount (x) at the filament center after the vibration test to the filament length in %.

COMPARATIVE EXAMPLE 4

A doped tungsten wire was prepared in the same manner as in Comparative example 3.

For the doped W wire thus obtained, the temperature was elevated by heating by current passage at temperature elevation rates of 1 A/sec. and 100 A/sec., respectively, up to 3140° C., and maintained for 5 minutes. As the result, the L/W's of the secondary recrystallized structures of the wires obtained were respectively 7 and 6.

Also, a filament was prepared in the same manner as in Example 1 except for using the doped W wire, and the compulsory vibration test was conducted under the same conditions as in Example 2 to obtain the results which are also listed together in Table 2.

COMPARATIVE EXAMPLE 5

A doped tungsten wire was prepared in the same manner as in Comparative example 1.

For the doped W wire thus obtained, the temperature was elevated by heating by current passage at temperature elevation rates of 1 A/sec. and 100 A/sec., respectively, up to 3140° C., and maintained for 5 minutes. As the result, the L/W's of the secondary recrystallized structures of the wires obtained were respectively 10 and 7.

Also, a filament was prepared in the same manner as in Example 1 except for using the doped W wire, and the compulsory vibration test was conducted under the same conditions as in Example 2 to obtain the results which are also listed together in Table 2.

TABLE 2

| | Secondary recrystallized structure | | Test results |
|---|---|---|---|
| | When temperate elevated gradually (1 A/sec.) | When temperature elevated momentarily (100 A/sec.) | Filament deformation ratio (%) |
| Example 2 | 12 | 12 | No deformation |
| Comparative example 4 | 7 | 6 | 20% |
| Comparative example 5 | 10 | 7 | 15% |

As is apparent from the above description, the doped W wire of the present invention is free from deformation of the filament prepared by use thereof even at high temperature during lighting and also excellent in vibration-proof property. This may be estimated to be due to the fact that the doped W wire of the present invention has large interlocking elongated grains in the secondary recrystallized structure, and also that the arrayed bubbles dispersed with the characteristics as specified above within the wire exhibit the fiber reinforcing function.

What is claimed is:

1. A vibration-proof tungsten wire having a structure comprising a crystal grain boundary at which bubbles of 0.3 μm or less in diameter are dispersed in bubble rows with lengths of $(0.39/D)^2 \times 3$ μm or more arrayed in the wire axis direction of said crystal grain boundary, and bubbles of 0.2 μm or less in diameter are randomly dispersed; and a crystal grain in which bubbles of 0.3 μm or less in diameter are dispersed in rows with lengths of $(0.39/D)^2 \times 30$ μm or more arrayed in the wire axis direction within said crystal grain, and bubbles of 0.2 μm or less in diameter are randomly dispersed, wherein D denotes the diameter of the wire in mm and an electric current corresponding to 90% of the fusion current value has been passed through the wire for 5 minutes.

2. A vibration-proof tungsten wire according to claim 1, wherein the crystal grains in a secondary recrystallized structure have a ratio of length to the width (L/W) of 9 or more.

3. A process for preparing a vibration-proof tungsten wire having a structure comprising a crystal grain boundary at which bubbles of 0.3 μm or less in diameter are dispersed in bubble rows with lengths of $(0.39/D)^2 \times 3$ μm or more arrayed in the wire axis direction of said crystal grain boundary, and bubbles of 0.2 μm or less in diameter are randomly dispersed; and a crystal grain in which bubbles of 0.3 μm or less in diameter are dispersed in rows with lengths of $(0.39/D)^2 \times 30$ μm or more arrayed in the wire axis direction within said crystal grain, and bubbles of 0.2 μm or less in diameter are randomly dispersed, wherein D denotes the diameter of the wire in mm, the process comprising the steps of subjecting ammonium para-tungstate to reduction at a temperature of 300° to 600° C. to form tungsten oxide; admixing as dopants a potassium compound, and at least one compound selected from the group consisting of a silicon compound and an aluminum compound to the resultant tungsten oxide to form a mixture; subjecting the resultant mixture to reduction in a stream of hydrogen at a temperature of 600° to 900° C. to form a metallic tungsten powder; subjecting the resultant metallic tungsten powder to acid washing to remove superfluous dopants therefrom; press-molding the resultant metallic tungsten powder followed by pre-sintering in a hydrogen furnace and subsequent sintering by current passage to give a tungsten sintered bar; subjecting the resultant tungsten sintered bar to swaging and drawing to obtain a tungsten wire; and then passing an electric current corresponding to 90% of the fusion current value through the resultant wire for 5 minutes.

4. A tungsten filament which has a diameter D in mm and comprises a crystal grain boundary at which bubbles of 0.3 μm or less in diameter are dispersed in bubble rows with lengths of $(0.39/D)^2 \times 3$ μm or more arrayed in the wire axis direction of said grain boundary, and bubbles of 0.2 μm or less in diameter are randomly dispersed; and a crystal grain in which bubbles of 0.3 μm or less in diameter are dispersed in rows with lengths of $(0.39/D)^2 30$ μm or more arrayed in the wire axis direction within said crystal grain, and bubbles of 0.2 μm or less in diameter are randomly dispersed.

5. A vibration-proof tungsten wire according to claim 2, wherein the crystal grains have the ratio (L/W) of 9 or more upon subjecting the wire to at least a secondary recrystallization temperature at any temperature elevation rate.

6. A process according to claim 3, wherein the ammonium para-tungstate is reduced at a temperature of 400° to 500° C.

7. A process according to claim 3, wherein the presintering is performed at a temperature of 1100° to 1300° C. for 3 to 4 hours.

8. A process according to claim 3, wherein the sintering is performed by passing a current of 3700 to 4050 A through the press-molded metallic tungsten powder for 15 to 20 minutes.

9. A process according to claim 3, wherein the bar subjected to the swaging has a cross sectional area 30% to 50% of which represents an increase over the cross sectional area of a bar having a diameter of 6 mm.

10. A vibration-proof tungsten wire according to claim 1, wherein the average density of the bubbles arrayed at the crystal grain boundary is not less than 500 bubbles/mm$^2$.

11. A vibration-proof tungsten wire according to claim 1, wherein the average density of the bubbles arrayed within the crystal grain is not less than 13 bubbles/mm$^2$.

* * * * *